US005148642A

United States Patent [19]

Plumier et al.

[11] Patent Number: 5,148,642

[45] Date of Patent: Sep. 22, 1992

[54] ANTISEISMIC STEEL STRUCTURAL WORK

[75] Inventors: Andre Plumier, Tilff; Raymond Baus, Liege, both of Belgium; Rene Pepin; Jean-Baptiste Schleich, both of Esch, Luxembourg

[73] Assignee: Arbed S.A., Luxembourg

[21] Appl. No.: 394,792

[22] Filed: Aug. 16, 1989

[30] Foreign Application Priority Data

Aug. 24, 1988 [LU] Luxembourg ..... 87320

[51] Int. Cl.[5] ..... E04H 9/02

[52] U.S. Cl. ..... 52/167 R; 52/633; 52/638; 52/729

[58] Field of Search ..... 52/167, 655, 729, 633, 52/167 CB, 167 R, 638, 283, 263; 403/2, 291

[56] References Cited

U.S. PATENT DOCUMENTS

| | | | |
|---|---|---|---|
| Re. 22,905 | 8/1947 | Scheyer | 403/2 |
| 225,060 | 3/1880 | Johnson | 52/283 |
| 514,151 | 2/1894 | Krause | 52/283 |
| 1,818,418 | 8/1931 | Millard | 52/263 |
| 2,616,529 | 11/1952 | MacDonald | 52/263 X |
| 3,290,949 | 12/1966 | Samet | 403/291 X |
| 3,367,009 | 2/1968 | Kuchera | 52/730 X |
| 3,565,210 | 2/1971 | Evans | 52/633 X |
| 3,716,957 | 2/1973 | Bernardi | 52/633 |
| 3,849,961 | 11/1974 | Gwynne | 52/655 X |
| 3,971,179 | 7/1976 | Bodocsi et al. | 52/272 X |
| 4,206,521 | 6/1980 | Davidson | 52/655 X |
| 4,282,692 | 8/1981 | Potthast | 52/283 |
| 4,348,843 | 9/1982 | Cairns | 52/167 R |
| 4,409,765 | 10/1983 | Pall . | |
| 4,417,426 | 11/1983 | Meng | 52/167 R X |
| 4,766,706 | 8/1988 | Caspe | 52/167 R X |
| 4,838,523 | 6/1989 | Humble et al. | 403/2 X |

FOREIGN PATENT DOCUMENTS

| | | | |
|---|---|---|---|
| 645908 | 3/1964 | Belgium | 52/633 |
| 0037884 | 10/1981 | European Pat. Off. . | |
| 356420 | 2/1990 | European Pat. Off. | 403/291 |
| 619608 | 2/1977 | U.S.S.R. | 52/167 CB |
| 998714 | 10/1981 | U.S.S.R. | 52/167 CB |
| 1278420 | 12/1984 | U.S.S.R. | 52/633 |
| 1328465 | 8/1987 | U.S.S.R. | 52/167 CB |

*Primary Examiner*—David A. Scherbel
*Assistant Examiner*—Robert J. Canfield
*Attorney, Agent, or Firm*—Fishman, Dionne & Cantor

[57] ABSTRACT

In antiseismic steel structural works of the frame type or of the truss type, which are constituted by columns and by girders fastened to the columns, the girders of different shapes show, at least in the vicinity of one of their extremities, a dissipative zone constituted by a reduction of the actual cross section. The reduction of the actual cross section consists either in differently shaped indentations in the edges of the flanges of the girder or in round or polygonal holes which are regularly distributed over the flanges and have a small diameter.

10 Claims, 3 Drawing Sheets

ANTISEISMIC STEEL STRUCTURAL WORK

TECHNICAL FIELD

The present invention relates to the seismic resistance of steel structural works comprising columns and sections which might be embedded in concrete.

BACKGROUND OF THE INVENTION

Numerous investigations made about the damage caused by earthquakes to buildings have shown that the metallic constructions behave, as a rule, better than buildings of stone or wood. One of the reasons for this better behaviour has to be found in the good ductility of the steel and in its capability to absorb energy regardless of the manner of application, which can be by traction, by compression or by shearing. Another of those reasons lies in the isotropy and homogeneity properties of this material. Care has of course, to be taken in order to preserve these specific properties of the material during its shaping to poles, beams or other sections, as well as during the assembling of those parts.

Generally, the buildings intended to resist to earthquakes are calculated to behave elastically under the action of forces which are defined in calculation codes. These design forces are generally less important than the forces liable to be applied to buildings during earthquakes, if these structures would remain solely in the elastic range. It is indeed admitted that the structure is capable to dissipate a large part of the transmitted energy through plastic deformations. As a result, it is required to design the structure by selecting the materials, the sections of the profiles and the assembling manner in such a way that the dissipated energy is very noticeably higher than the elastic energy stored for the same load level.

The calculated forces, illustrating the action of an earthquake on a building of a given structure in a given geographical area are characterized as follows:

they are proportional to the mass of the building, they are a function of the vibrational characteristics, i.e. fundamental frequencies, of the building, they are dependant on the capability of the building to absorb the energy of the earthquake according to stable mechanisms of the plastic joint type, called "dissipative zones".

It is not easy to substantially modify in a more favourable sense the effect of the two first above quoted parameters. Indeed the mass is directly linked to the purpose for which a building is erected and the fundamental frequencies cannot be easily influenced, as the conditions limiting the deformations block within a relatively narrow spectrum the frequencies of the actual structures. The last parameter, linked to the energy dissipating capability of the building, allows however variations within very extended limits. So, design loads varying within the ratio of 1 to 6 can be taken into consideration, the smaller of the design loads corresponding to the more dissipative structures.

The calculation codes define a given number of conditions which must be observed in order to attain the smaller design loads and, as a consequence thereof, the lighter structures. These conditions concern:

the topology of the structures, the slenderness of the section elements, and the dimensions of the assemblies; these latter must be such that the dissipative zones are lying outside of the said assemblies, as these latter are normally not capable to develop plastic mechanisms which are stable and ductile.

This latter aim is attained by prescribing for the assemblies a resistance $R_d$ which is superior to 120% of the plastic resistance $R_{fy}$ of the assembled bars according to the formula:

$$R_d > 1,2\ R_{fy}.$$

In the frames $R_{fy}$ represents the plastic moment $M_p$ of the bars. In the trusses $R_{fy}$ is the normal plastic effort $N_p$ the bars. This being a very stringent condition, the assemblies resulting out of such calculations are very expensive and difficult, if not impossible, to realize.

SUMMARY OF THE INVENTION

It is the object of the present invention to provide a metallic structure which guarantees an excellent behaviour during earthquakes and which nevertheless is light, easy to realise and economical.

This aim is achieved according to the present invention by a metallic structure comprising girders which show, at least in the vicinity of one of their extremities, a local dissipative zone formed by a reduction of the actual cross section of the profile. Various preferred embodiments are described in the dependant claims.

The advantage resulting from the invention lies in the fact that the condition $$R_d > 1,2\ R_{fy}$$

is applicable while considering the value $R_{fy}$ of the reduced cross section of the profile. This allows to bring the assemblies back to normal dimensions, which, although somewhat more important, are nevertheless comparable to those of classical projects. At the same time the presence of a dissipative zone is guaranteed and it is permissible to take the full benefit from the reduction of the design loads corresponding to the seismic action.

BRIEF DESCRIPTION OF THE DRAWINGS

The invention will become more readily apparent from the following description, reference being made to the accompanying drawings showing several preferred embodiments.

FIGS. 1 and 2 show the column 1 to which is fastened a girder 3 through the intermediary of the end plate 2. The connection of the end plate to the girder is usually realized by welding, whereas the end plate is bolted to the column.

DETAILED DESCRIPTION OF THE INVENTION

Figure 1:
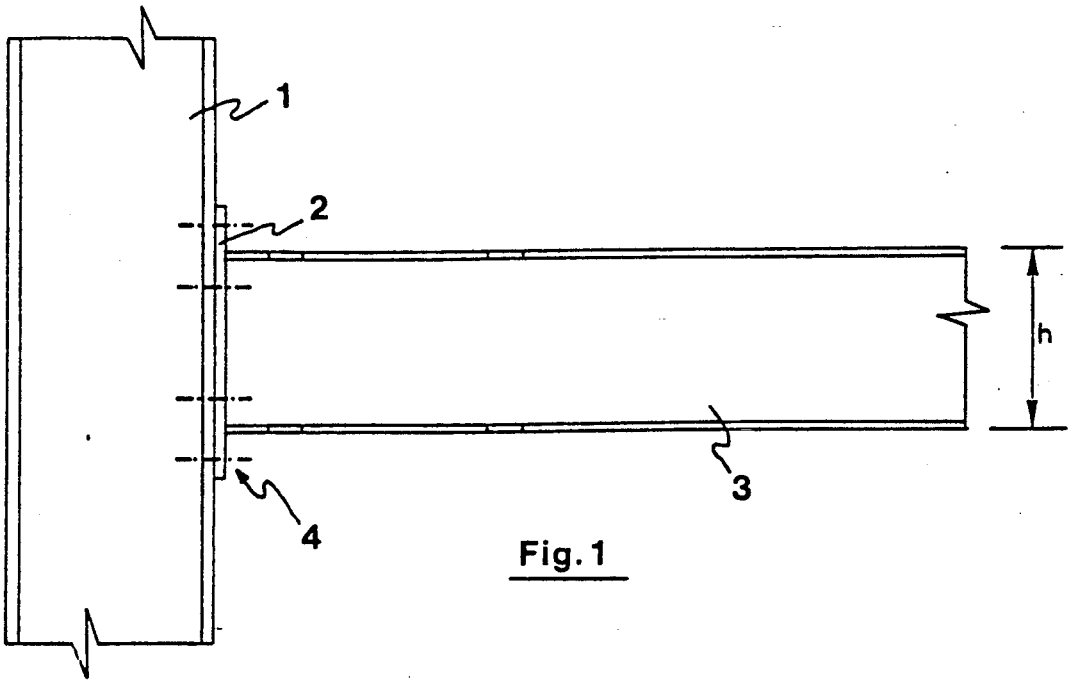
FIG. 1 is a side elevational view of a frame structure.
Figure 2:
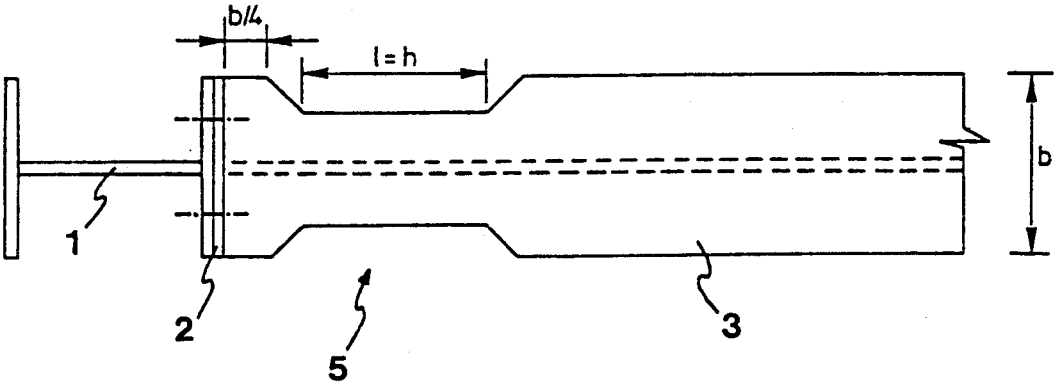
FIGS. 2 & 3 are top views of the frame structure.

FIGS. 1 and 2 show a column 1 to which is fastened a girder 3 through a plate 2.

According to one of the prescriptions of the Codes, the dissipative zones of the frame structures, as well of the metallic ones as of the steel/concrete composite ones, must lie within the girders but not within the columns. The cross section of the girder in the vicinity of the connection 4 has been diminished according to the invention over a length 1 equal to the height h of the girder 3. This length is in fact the minimum length required for the formation of a plastic hinge. The magnitude of the constriction 5 can correspond to 30% of the width b of the flanges of the girder 3. The minimum distance between the beginning of the constriction 5 and the connection 4 is in the order of magnitude of one fourth of the width b of the flanges of the girder 3. For the shown trapezoidal indentation the great base of the trapezium lies along the edge of the flange and the small base has a length equal to the height of the beam. The non parallel sides of the trapezium form with the great base an angle of at most 60°.

Figure 3:
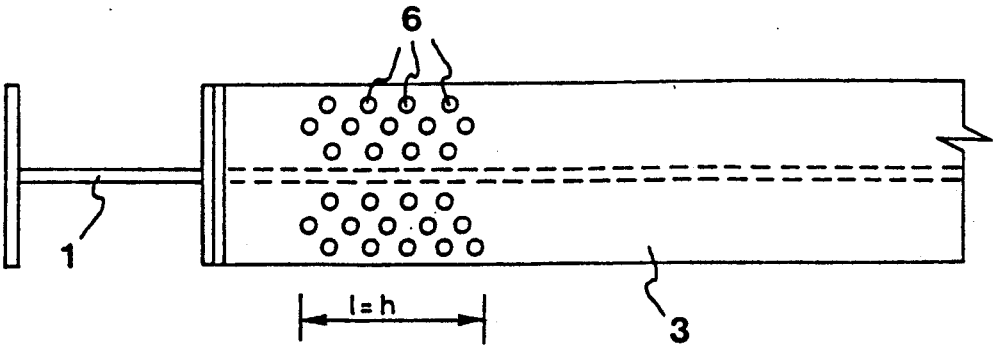

Instead of having a trapezoidal shape, the actual reduction of the cross section of the girder can also be achieved by drilling or by punching multiple holes 6 such as illustrated by FIG. 3.

Figure 4:
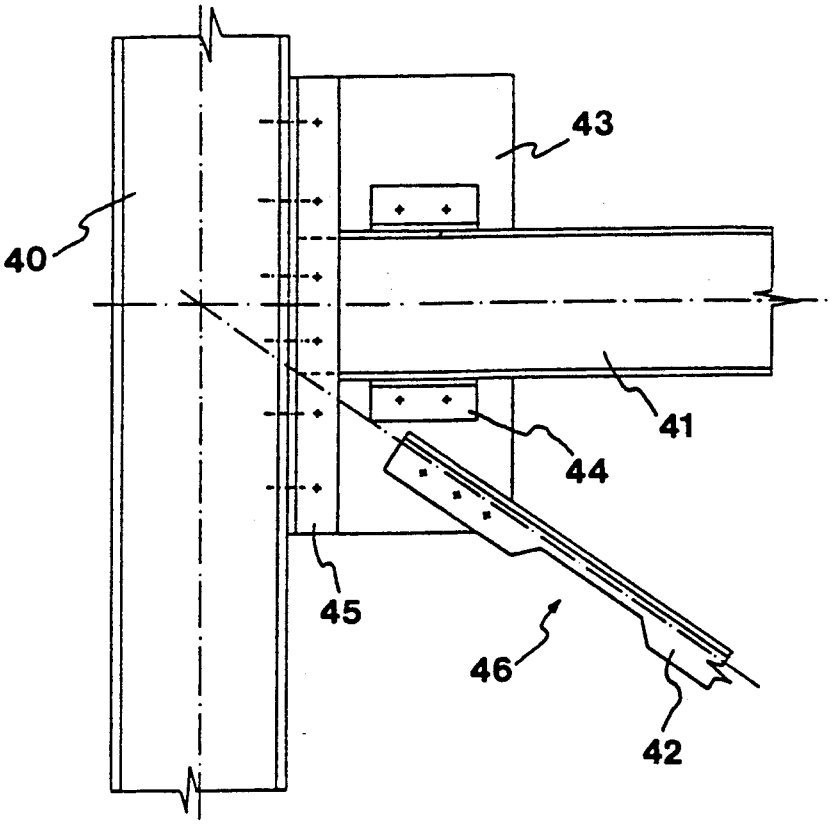
FIGS. 4–6 are side elevational views of three different embodiments of truss structures.

FIG. 4 shows a part of a truss structure. The tension diagonals 42 are constituted by angles. The upper cross member 41, constituted by U-shaped sections, is fastened with the help of a gusset 43 and of angles 44 and 45 to the column 40. It has to be noticed that if U-shaped sections or angles are assembled in such a way to a single wall, it is often impossible to realize a dissipative zone of a classical conception. In such cases, the invention foresees, according to a most favourable embodiment, a reduction of the cross section 46 of the tension diagonals 42 in order to constitute a dissipative zone which is reliable in traction. As a general rule it is possible to foresee such a dissipative zone towards each extremity of the tension diagonals. In order to save fabrication costs, the dissipative zones are generally limited to the required number. Mostly, they are foreseen near one of the extremities, which generally is that extremity fastened to the upper girder.

Figure 5:
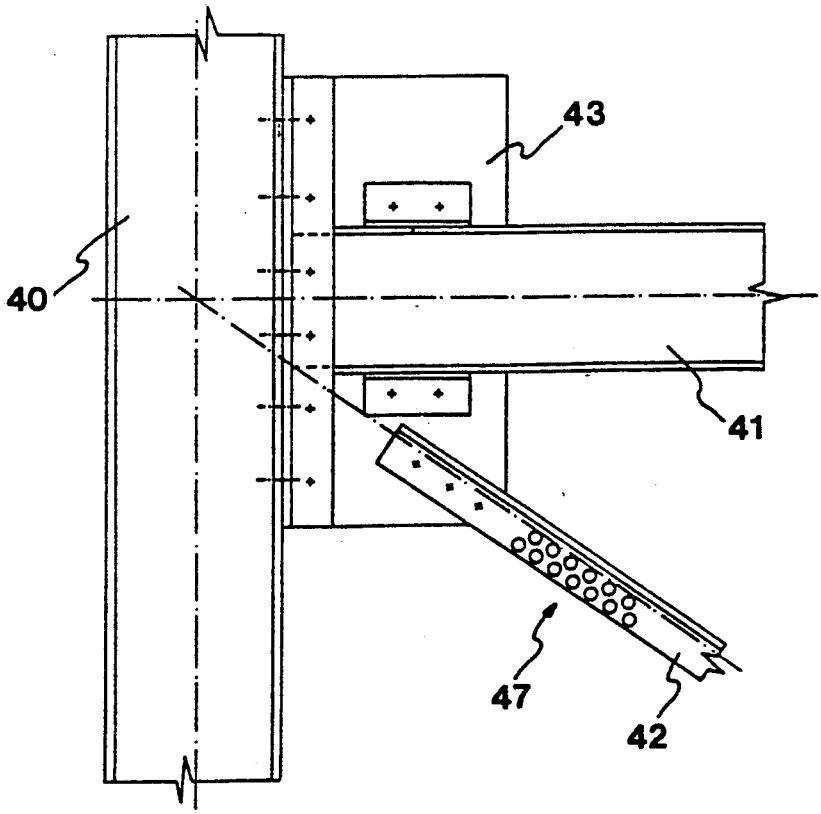

According to the execution form illustrated by FIG. 5, the tension diagonal 42 shows a reduction of the actual cross section which results from a multitude of drillings 47. The holes which may have any cross sectional shape show a relatively small surface and are regularly distributed over the girder extremity.

Figure 6:
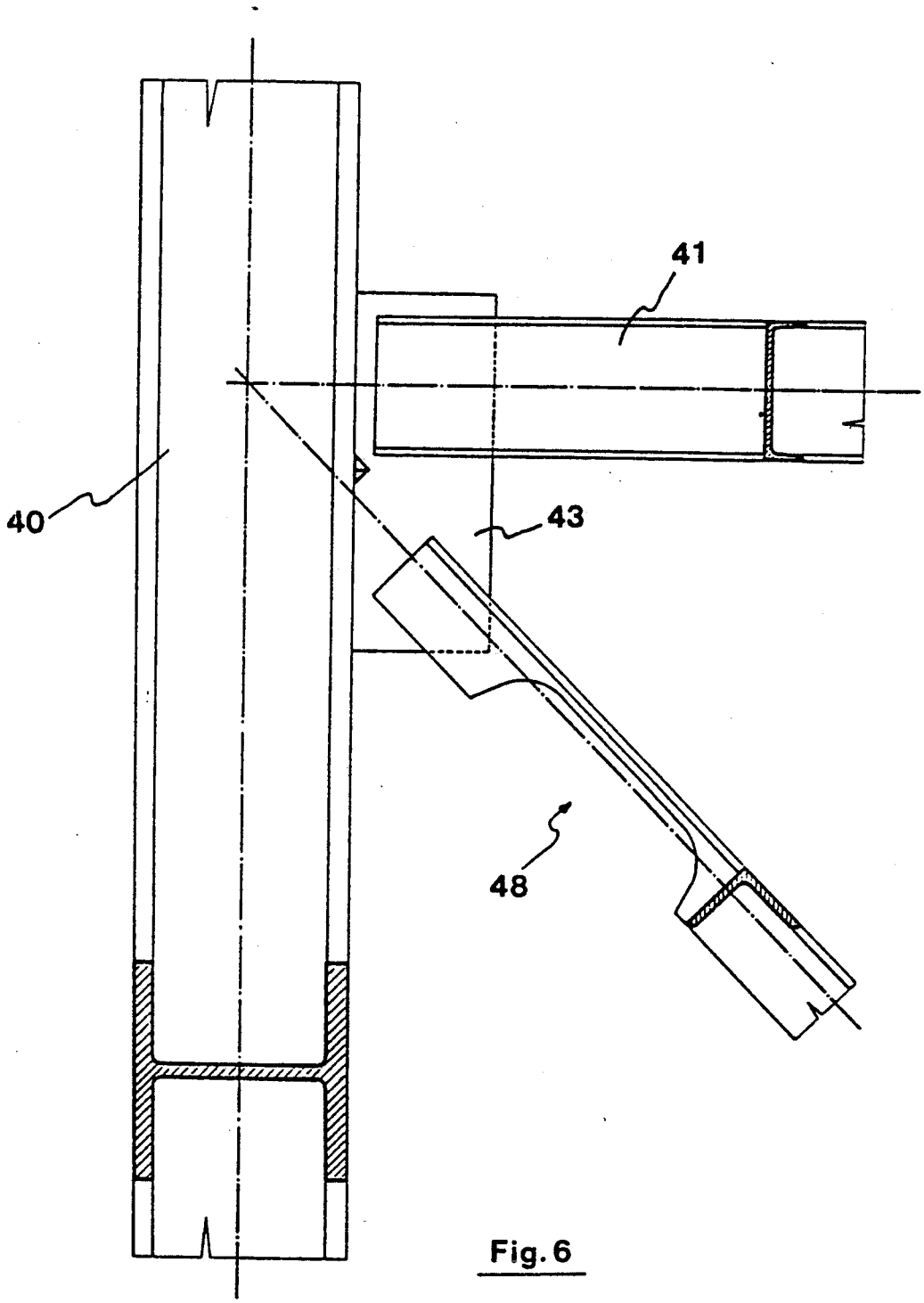

FIG. 6 exemplifies a simpler girder structure in which the upper girder 41 is fastened directly to the gusset 43. In a similar way, the gusset 43 is directly welded to the column 40. The actual reduction of the cross section 48 is constituted in this example by the ellipsoidal indentation of one of the two flanges of the angle. Alternatively, it is also possible to operate less important cuttings in the two flanges of the angle.

The suggested solution entails on the one hand a loss of the useful cross section of the diagonals, which might be in the order of magnitude of 50% but on the other hand the reduction rate of the calculation forces is equal to a figure of 4 if the girder structure can be considered as a dissipative one. The overall result remains consequently a diminution of the steel used for the diagonals by a factor which is of the order of magnitude of 2.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A metal structure, comprising:

a vertical metal column; and a metal girder extending horizontally from the column and having an end secured to the column, said girder having a substantially uniform cross-sectional area and having a dissipative zone of reduced cross sectional area near the end of the girder, said dissipative zone being capable of undergoing bending and functioning as a plastic hinge effective to provide resistance to seismic vibrations, said girder further comprising a pair of flat opposed flanges, said flanges extending longitudinally between two opposed edges and a base extending perpendicularly between the flanges, and wherein said dissipative zone comprises opposed indentations in the opposed edges of the flanges.

2. The structure of claim 1, additionally comprising gusset means for securing the girder to the column.

3. The structure of claim 1, wherein the indentations comprise trapezoidal indentations.

4. The structure of claim 3, wherein the opposed edges of each flange define a flange width, each trapezoidal indentations comprise a greater base, an opposed lesser base parallel to the greater base and a pair of opposed sides between the bases, and wherein each side forms an angle of up to about 60° with the greater base and the bases are separated by a distance that of up to about 30% of the width of the flange.

5. The structure of claim 1, wherein the indentations comprise ellipsoidal indentations.

6. The structure of claim 1, wherein the indentations comprise rectilinear indentations.

7. The structure of claim 1, wherein flanges comprise opposed outer and inner surfaces between the opposed edges, the base extends between the inner surfaces of the flanges and the outer surfaces of the opposed flanges define girder height, and at least one indentation extends along an edge of a flange for a distance greater than or equal to the girder height.

8. The structure of claim 1, wherein the zone comprises a plurality of holes through the flange, said holes being regularly distributed throughout the zone.

9. The structure of claim 1, wherein the girder is an I-beam.

10. A metal structure, comprising:

a vertical metal column; and a metal girder extending horizontally from the column and having an end secured to the column, said girder having a substantially uniform cross sectional area and having a dissipative zone of reduced cross sectional area near the end of the girder, said dissipative zone being capable of undergoing bending and functioning as a plastic hinge effective to provide resistance to seismic vibrations, wherein said dissipative zone exhibits a first plastic resistance to deformation and said structure exhibits a second resistance to deformation which is greater than 120% of the first plastic resistance to deformation.

* * * * *

UNITED STATES PATENT AND TRADEMARK OFFICE

CERTIFICATE OF CORRECTION

PATENT NO. : 5,148,642

DATED : September 22, 1992

INVENTORS : Andre Plumier et al

It is certified that error appears in the above-identified patent and that said Letters Patent is hereby corrected as shown below:

Col. 2, line 8: Delete " $R_d > 1, 2\ R_{fy}$ " and insert therefor – $R_d > 1.2\ R_{fy}$ –.

Col. 2, line 12: Insert –of– after " $N_p$ ".

Col. 2, line 31: Delete " $R_d > 1, 2\ R_{fy}$ " and insert therefor – $R_d > 1.2\ R_{fy}$ –.

Col. 4, line 40: Insert – a – after "define".

Signed and Sealed this

Twenty-eighth Day of December, 1993

*Attest:*

Bruce Lehman

BRUCE LEHMAN

*Attesting Officer*

*Commissioner of Patents and Trademarks*